US005562784A

United States Patent [19]

Nishikawa et al.

[11] Patent Number: 5,562,784

[45] Date of Patent: Oct. 8, 1996

[54] ALUMINUM ALLOY SUBSTRATE FOR ELECTROLYTICALLY GRAINABLE LITHOGRAPHIC PRINTING PLATE AND PROCESS FOR PRODUCING SAME

[75] Inventors: Yasuhisa Nishikawa; Hideki Suzuki, both of Ihara-gun; Hirokazu Sakaki; Yoshinori Hotta, both of Haibara-gun, all of Japan

[73] Assignees: Nippon Light Metal Company, Ltd., Tokyo; Fuji Photo Film Company, Ltd., Kanagawa, both of Japan

[21] Appl. No.: 350,820

[22] Filed: Dec. 7, 1994

[30] Foreign Application Priority Data

Dec. 13, 1993 [JP] Japan ..... 5-341148

[51] Int. Cl.[6] ..... C22F 1/04

[52] U.S. Cl. ..... 148/549; 148/551; 148/552; 148/695; 148/696

[58] Field of Search ..... 148/549, 551, 148/552, 695, 696, 437, 438; 101/459

[56] References Cited

U.S. PATENT DOCUMENTS

| | | | |
|---|---|---|---|
| 4,939,044 | 7/1990 | Ohashi et al. | 148/437 |
| 5,350,010 | 9/1994 | Sawada et al. | 148/551 |

FOREIGN PATENT DOCUMENTS

| | | |
|---|---|---|
| 0193710 | 9/1986 | European Pat. Off. . |
| 0415238 | 3/1991 | European Pat. Off. . |
| 3-79798 | 4/1991 | Japan . |
| 5-156414 | 6/1993 | Japan . |

OTHER PUBLICATIONS

Patent Abstract of Japan, vol. 17, No. 544 (C–1118) 60CT93 & JP A 5–156414 (Fuji Photo Film Co., Ltd.) 22 Jun. 1993.

Metals Handbook, 10th Edition, vol. 2, 1990, American Society for Metals, Metals Park, Ohio, US (Alloy and Temper Designation Systems for Aluminum and Aluminum Alloy, pp. 15–17, table 2).

*Primary Examiner*—David A. Simmons
*Assistant Examiner*—Robert R. Koehler
*Attorney, Agent, or Firm*—Fisher McAulay; Nissen Goldberg & Kiel, LLP

[57] ABSTRACT

An aluminum alloy substrate for an electrolytically grainable lithographic printing plate, consisting of an aluminum alloy cold-rolled sheet, produced by a continuous casting and rolling process, comprising 0.20 to 0.80 wt % of Fe with the balance consisting of aluminum, grain refining elements, and unavoidable impurities including 0.3 wt % or less of Si and 0.05 wt % or less of Cu, grains in a surface layer portion having a width of not more than 150 μm in a direction parallel to the sheet surface and normal to the direction of cold rolling and a length, in a direction parallel to the direction of cold rolling, of not more than 8 times the width.

4 Claims, No Drawings

ALUMINUM ALLOY SUBSTRATE FOR ELECTROLYTICALLY GRAINABLE LITHOGRAPHIC PRINTING PLATE AND PROCESS FOR PRODUCING SAME

BACKGROUND OF THE INVENTION

1. Field of the Invention

The present invention relates to an aluminum alloy substrate for an electrolytically grainable lithographic printing plate having a good electrolytic graining property, particularly excellent in uniformity of appearance after electrolytic graining.

2. Description of the Related Art

Conventional aluminum alloy substrates for a support for an electrolytically grainable lithographic printing plate are generally provided in the form of an about 0.1 to 0.5 mm thick cold-rolled sheet made of an aluminum alloy such as JIS A1050, A1100, A3003, or the like. Such aluminum alloy cold-rolled sheets are generally produced by machining the surface of a semicontinuous-cast (DC) slab, homogenization heat-treating the slab when necessary, heating the slab to a selected temperature, hot-rolling the heated slab to a hot-rolled strip, cold-rolling the hot-rolled strip with an intermediate annealing between the cold rolling passes, and final cold rolling the strip to a cold-rolled sheet.

Japanese Unexamined Patent Publication (Kokai) No. 3-79798 discloses a process for producing an aluminum alloy support for an electrolytically grainable lithographic printing plate, in which an aluminum alloy melt is continuously cast and rolled to form a strip coil which is then subjected to cold rolling, heat treatment, and straightening.

Japanese Unexamined Patent Publication (Kokai) No. 5-156414 discloses a process for producing an aluminum alloy support for an electrolytically grainable lithographic printing plate, which comprises carrying out twin-roll continuous casting and rolling and then hot rolling to prepare a strip coil having a thickness of 4 to 30 mm which is then cold-rolled, with heat treatment at a temperature of 400° C. or above being carried out in the course of the cold rolling when the thickness of the rolled sheet has reached 1 mm, and further cold-rolled. It further discloses a process for producing an aluminum alloy support for an electrolytically grainable lithographic printing plate, which comprises carrying out twin-roll continuous casting and rolling and then hot rolling to prepare a strip coil having a thickness of 4 to 30 mm which is then heat-treated at a temperature of 300° C. or above and cold-rolled with heat treatment at a temperature of 300° C. or above being again carried out in the course of the cold rolling.

The above conventional processes are disadvantageous in that the production steps are complicated and involve time consuming treatment, inevitably increasing costs.

Further, in the above conventional processes, in order to attain a good electrolytically graining property and provide a good uniformity in appearance of the support after graining, conditions should be regulated for each of the steps of casting, heat treatment for homogenization, hot rolling, and intermediate annealing during cold rolling. In particular, in order to provide a good uniformity in appearance after graining, the regulation of grains should be carried out for each of the steps of casting, heat treatment for homogenization, hot rolling, and intermediate annealing during cold rolling.

Furthermore, steps requiring a high temperature and much time, such as heat treatment for homogenization and hot rolling, are required for the production of an aluminum alloy substrate having a desired thickness from a slab prepared by semicontinuous casting (DC casting). Even though each of the above steps can be successfully regulated, elements dissolved in supersaturation in a solid solution form during casting unfavorably precipitate during these steps conducted at a high temperature for a long period of time, resulting in the formation of coarse recrystallized grains during hot rolling. Even though subsequent heat treatment and working can provide small recrystallized grains, traces of the coarse recrystallized grains produced during the hot rolling remain as they are and appear as streaks (a streak pattern) extending in the rolling direction, which causes a lower uniformity in appearance of the electrolytically grained surface.

In the case of the processes disclosed in Japanese Unexamined Patent Publication (Kokai) Nos. 3- 79798 and 5-156414 and the selection of improper conditions for the heat treatment in the course of cold rolling, the electrolytic graining is nonuniform, resulting in poor uniformity in appearance of the grained surface.

When an aluminum alloy substrate for a printing plate is electrolytically grained, it is a common practice to optionally carry out as a pretreatment chemical etching with an acid or alkali for degreasing or removal of oxide films from the surface of the substrate. The electrolytic graining process, as such, is an electrolytic etching process wherein an alternating current is applied using as a counter electrode graphite or the like to cause electrolytic etching, thereby forming pits on the surface of the substrate to provide a grained surface.

The above graining enhances an adhesion of a photosensitive film and water retention, beneficial to printing performance, to the printing plate. Since adhesion and water retention should be provided uniformly over the whole surface of the printing plate, pits should be formed uniformly over the whole printing plate. For a printing plate provided with a photosensitive film, the grained surface should have a uniform appearance when viewed with the naked eye because the results of development after the exposure and development are evaluated by visual inspection.

Nonuniform electrolytic graining means that proper surface roughness cannot be attained due to excessive etching (dissolution type) or the presence of a region remaining unetched in the electrolytic etching. In this case, a problem occurs associated with the suitability of the plate for use in printing. Specifically, the adhesion of a photosensitive film to the printing plate becomes poor, and, further, the water retention or corrosion resistance in nonimage areas deteriorates, which in turn leads to tinting or scumming in nonimage areas during printing.

Nonuniform appearance of the grained surface means nonuniform color tone such as observation of streaks (a streak pattern) along the rolling direction or partial loss of gloss to give a cloudy appearance. This is caused by nonuniform chemical etching as a pretreatment and electrolytic etching as an electrolytic graining treatment (nonuniform etching, the presence of a region remaining unetched or excessive etching) and an nonuniform metallic structure.

The nonuniform metallic structure is attributable to nonuniform grain orientation and grain size, coarsening and nonuniform dispersion of an intermetallic compound, and the like. Even when the nonuniformity of the metallic structure is of an extent that is not detrimental to the uniformity of electrolytic graining (including pretreatment) necessary for printing, it often makes the appearance of the grained surface remarkably nonuniform.

A nonuniform appearance, i.e., the presence of cloudy color shading, in the grained surface is very inconvenient to inspection of image areas after development. Specifically, the cloudy portions are present as they are in nonimage portions after development, and since they have a color tone similar to the image areas, it becomes difficult to visually judge whether or not the image areas can be satisfactorily developed.

SUMMARY OF THE INVENTION

Accordingly, an object of the present invention is to provide an aluminum alloy substrate for an electrolytically grainable lithographic printing plate by a continuous casting and rolling process, which aluminum alloy substrate can be uniformly grained by electrolysis and, at the same time, can have a uniform appearance after electrolytic graining.

Another object of the present invention is to provide a process for producing an aluminum alloy substrate for an electrolytically grainable lithographic printing plate by a continuous casting and rolling process, which aluminum alloy substrate can be uniformly grained by electrolysis and, at the same time, can have a uniform appearance after electrolytic graining, through simple steps not requiring much time, at a low cost, and with a high efficiency.

In order to attain the above objects, according to one aspect of the present invention, there is provided an aluminum alloy substrate for an electrolytically grainable lithographic printing plate, consisting of an aluminum alloy cold-rolled sheet, produced by a continuous casting and rolling process, comprising 0.20 to 0.80 wt % of Fe with the balance consisting of aluminum, grain refining elements, and unavoidable impurities including 0.3 wt % or less of Si and 0.05 wt % or less of Cu, grains in a surface layer portion having a width of not more than 150 μm in a direction parallel to the sheet surface and normal to the direction of cold rolling and a length, in a direction parallel to the direction of cold rolling, of not more than 8 times said width.

In order to attain the above objects, according to another aspect of the present invention, there is provided a process for producing an aluminum alloy substrate for an electrolytically grainable lithographic printing plate, said process comprising the steps of:

preparing a melt of an aluminum alloy consisting of 0.20 to 0.80 wt % of Fe with the balance consisting of aluminum, grain refining elements, and unavoidable impurities including 0.3 wt % or less of Si and 0.05 wt % or less of Cu;

continuously casting and rolling said melt to form a strip having a thickness of 20 mm or less;

cold-rolling the strip with hot treatment being carried out in the course of the cold rolling;

thereby regulating the dimension and shape of grains in a surface layer portion of the cold-rolled sheet so that the width in a direction parallel to the sheet surface and normal to the direction of cold rolling is not more than 150 μm and the length in a direction parallel to the direction of cold rolling is not more than 8 times said width.

DESCRIPTION OF THE PREFERRED EMBODIMENTS

The heat treatment in the course of the cold rolling is preferably carried out at least once by rapid heating sufficient to prevent local grain growth during heating.

The rapid heating is preferably carried out at a temperature rise rate of not less than 1° C./sec, and the heat treatment by rapid heating is preferably carried out in the temperature range of from 440° to 600° C.

The present inventors have carried out various studies with the intention of solving the above problems of the prior art and, as a result, have found that the uniformity of electrolytic graining and the uniformity of appearance of the grained surface can be ensured by continuously casting and rolling an aluminum alloy having a chemical composition specified above and regulating the dimension and shape of grains in a surface layer portion of the cold-rolled sheet so as to fall within the respective ranges specified above, which has led to the realization of the aluminum alloy substrate for an electrolytically grainable lithographic printing plate according to the present invention.

Further, the present inventors have found that the dimension and shape of grains falling within the respective ranges specified above can be achieved through recrystallization of the aluminum alloy by heating in the course of cold rolling after continuous casting and rolling, which has led to the realization of the process for producing an aluminum alloy substrate for an electrolytically grainable lithographic printing plate according to the present invention.

The reason why the continuous casting and rolling process is used in the present invention is as follows.

As compared with DC casting, the continuous casting and rolling can provide a cast material having a much smaller thickness, the surface of which can be, therefore, solidified at a higher rate. This renders the crystallized particles so fine and uniform that, unlike the DC casting process, the continuous casting process needs no heat treatment of the slab for homogenization. Since no treatment requiring a high temperature and much time is carried out, neither the precipitation of elements dissolved in supersaturation in a solid solution form nor the formation of coarse recrystallized grains occurs. Furthermore, there occurs no deterioration in uniformity of appearance of the electrolytically grained surface due to streaks (a streak pattern) caused by the above unfavorable phenomena.

The cast material produced by continuous casting and rolling has a much smaller thickness than the cast material produced by the DC process and, hence, can be directly cold-rolled without hot rolling. Even though the cast material is relatively thick and is hot-rolled before cold rolling, since the cast material produced by continuous casting and rolling is still much thinner than the cast material produced by the DC process, the hot rolling to a thickness suitable for cold rolling may be completed in a very short time and requires neither high temperature nor much rolling time.

The chemical composition specified above is used in the present invention for the following reasons.

The Fe content must be within the range of from 0.20 to 0.80 wt %. Fe is necessary for improving the mechanical strength. When the Fe content is below the lower limit value, the effect is unsatisfactory, while when it exceeds the upper limit value, Al-Fe intermetallic compounds in the form of coarse particles are crystallized reducing the uniformity of pits formed by electrolytic graining. The Fe content is preferably not more than 0.50 wt %.

The Si content must not be more than 0.3 wt %. Si is found in aluminum alloys as an impurity element and must not be present in an amount of more than 0.3 wt % because, when present in a larger amount, it reduces the uniformity of the electrolytic graining.

The Cu content must not be more than 0.05 wt %. Although Cu is also an impurity element found in aluminum alloys, Cu is preferably present in an amount of 0.001 wt % or more because it has a favorable effect on uniformity of electrolytic graining. However, Cu present in an excessive amount causes formation of coarse pits during electrolytic graining and reduces the uniformity of electrolytic graining. Therefore, the Cu content must not be more than 0.05 wt %, and preferably not more than 0.03 wt %.

The grain refining elements may be present in the aluminum alloy to refine the grains, thereby preventing the occurrence of cracking during casting. For example, 0.01 to 0.04 wt % Ti or 0.0001 to 0.02 wt % B may be present to this end.

Other impurities such as Mg, Mn, Cr, Zr, V, Zn, and Be may be occasionally present and are considered harmless when present in trace amounts of not more than about 0.05 wt %.

In the aluminum alloy cold-rolled sheet of the present invention, grains in a surface layer portion have a width of not more than 150 μm in a direction parallel to the sheet surface and normal to the direction of cold rolling and a length, in a direction parallel to the direction of cold rolling, of not more than 8 times the above width. The term "surface layer portion" used herein is intended to mean a region, involved in graining, from the surface of the sheet to at least about 30 μm from the surface of the sheet.

In the continuously cast and rolled aluminum alloy cold-rolled sheet having the chemical composition specified above, when the surface layer portion is brought to the above metallic structure, unlike the aluminum alloy cold-rolled sheet by DC casting, no coarse recrystallized grain formed in the step of hot rolling is present, so that there occurs no deterioration in uniformity of appearance of the electrolytically grained surface due to streaks (a streak pattern) attributable to coarse recrystallized grains.

When the width and length of the grains in the surface layer portion of the cold-rolled sheet are outside the above respective ranges, streaks occur, so that no uniform appearance of the grained surface can be obtained.

The width of the grains in the surface layer portion of the cold-rolled sheet is still preferably not more than 120 μm. The ratio of the length to the width (elongation) is generally not less than 1.5, preferably not more than 6.

The thickness of the aluminum alloy substrate for an electrolytically grainable lithographic printing plate according to the present invention is generally not more than 1 mm, preferably in the range of from 0.1 to 0.5 mm.

According to the process of the present invention wherein a coil of an aluminum alloy strip is formed by continuous casting and rolling, heat-treated for recrystallization in the course of cold rolling and then applied to steps up to final cold rolling, an aluminum alloy substrate in the form of a cold-rolled sheet, of which the dimension and shape of grains in the surface layer portion fall within the above respective ranges, can be produced through simple steps not requiring much time at a low cost with a high efficiency. In this case, in order to surely bring grains to a state desirable for attaining uniform appearance of the electrolytically grained surface, it is important to properly select conditions for continuous casting and rolling and conditions for heat treatment for recrystallization in the course of cold rolling.

In the production of a continuously cast and rolled sheet, a melt of an aluminum alloy produced by the melt process with slag off treatment is brought to a strip (rolling slab) having a thickness of not more than 20 mm by the hunter process, 3C process, Hazelette process, or belt caster process, which is then coiled. By this, the melt of an aluminum alloy is rapidly solidified to sufficiently dissolve alloy ingredients in a solid solution form in the matrix, and, at the same time, the secondary phase particles are homogeneously and finely crystallized. When the sheet thickness is not less than 20 mm, this effect is unsatisfactory. Further, the large thickness makes it necessary to increase the number of steps of cold rolling, resulting in lowered productivity.

An aluminum alloy strip having a thickness of not more than 20 mm is formed from the melt of an aluminum alloy by continuous casting and rolling and then coiled. The coil is then cold-rolled, without hot rolling for homogenization, to an aluminum alloy substrate having a desired sheet thickness. In this case, when heat treatment is not carried out under proper conditions in the course of cold rolling, electrolytic graining is nonuniform and, at the same time, the appearance of the grained surface is nonuniform.

In particular, in order to ensure uniformity of appearance of the grained surface, it is important to select conditions for heat treatment in the course of cold rolling so that the width of the grains in a direction normal to the rolling direction in a surface layer portion after the final cold rolling is not more than 150 μm and, at the same time, to select conditions for cold rolling so that the ratio of the length of the grains in the rolling direction to the width (elongation), when the sheet has been brought to a desired thickness by cold rolling after heat treatment, is not more than 8.

Specifically, the width of grains in the surface layer portion of the substrate after the final cold rolling is substantially the same as that of recrystallized grains formed by the heat treatment in the course of the cold rolling. Therefore, the width of the grains in the surface layer portion after the final cold rolling is substantially determined by the heat treatment in the course of the cold rolling. On the other hand, the length of the grains in the surface layer portion after the final cold rolling is determined by the degree of an increase in length of recrystallized grains, formed in the heat treatment in the course of cold rolling, by cold rolling after the heat treatment.

According to a preferred embodiment of the heat treatment in course of cold rolling, the sheet is heated using a continuous annealing apparatus at a temperature rise rate of not less than 1° C./sec to a temperature in the range of from 440° to 600° C. and cooled immediately after the temperature has reached a predetermined value, or after holding the sheet at a predetermined temperature for about 30 min or less.

The temperature is raised at a rate of not less than 1° C./sec because the temperature rise rate is preferably as high as possible from the viewpoint of uniformity of appearance of the electrolytically grained surface. Studies conducted by the present inventors have revealed that, when temperature rise rate is excessively low, the recrystallized grains are entirely or partially coarsened, making it difficult to attain uniform appearance of the grained surface. Although the mechanism for this phenomenon has not been fully elucidated yet, it is thought to be as follows.

In general, the size of grains upon completion of the recrystallization varies mainly depending upon the number of recrystallization nuclei and the growth rate of subgrains. The larger the number of recrystallization nuclei or the higher the growth rate of subgrains, the smaller the size of recrystallized grains.

The recrystallization nuclei are likely to occur in nonuniformly deformed regions. Such regions include the vicinity of coarse dispersed particles and old grain boundaries and deformed zones and shear zones formed by plastic working.

On the other hand, the growth of the subgrains is inhibited by the presence of fine particles, for example, finely precipitated particles.

For the aluminum alloy cold-rolled sheet by continuous casting and rolling according to the present invention, the major portion of elements dissolved to supersaturation in a solid solution form, composed mainly of Fe, at the time of casting is maintained as it is. Therefore, the secondary phase compound particles are likely to finely precipitate during the heat treatment for recrystallization, which fine particles inhibit the growth of subgrains, coarseting recrystallized grains. In order to prevent this unfavorable phenomenon, the temperature should be rapidly raised to the recrystallization temperature.

The heat treatment is carried out at a temperature of 440° C. or above because, in this temperature range, the recrystallization occurs to a sufficient extent, enabling uniformity of electrolytic graining and uniformity of appearance of the grained surface to be easily ensured. However, if the heat treatment temperature is excessively high, the strength of the substrate is likely to decrease during the heat treatment, causing deformation. Further, recrystallized grains are likely to coarsen. For the above reason, the heat treatment temperature is preferably 600° C. or below.

When the holding time in the heat treatment is excessively long, recrystallized grains are coarsened, so that the holding time is usually preferably 10 min or less, still preferably 2 min or less.

Cooling from the heat treatment temperature is preferably as rapid as possible from the viewpoint of improving the productivity. For example, the sheet is cooled at a rate of not less than 1° C./sec to a temperature of 100° C. or below. Rapid cooling with water at a rate of not less than 500° C./sec is more preferred.

The heat treatment may be carried out in a conventional continuous annealing furnace, and heating in the heat treatment may be of transverse flux induction heating type. Transverse flux induction heating is particularly preferred because heating is carried out by taking advantage of heat generated from the material to be heat-treated, which is less likely to form an oxide film on the surface of the material to be treated and, hence, less likely to have an adverse effect on the graining treatment.

As described above, the purpose of heat treatment in the course of cold rolling is to bring the width of grains in a surface layer portion after the final cold rolling to not more than 150 μm, thereby enabling the appearance of the grained surface to be uniform. The heat treatment is, as described above, preferably carried out by rapid heating so as to prevent recrystallized grains from coarsening. It is carried out once or a plurality of times in the course of the cold rolling. In the case of a plurality of heat treatments, when at least one of them is carried out by the above rapid heating, the effect of preventing the recrystallized grains from coarsening can be attained by the rapid heating. It is also possible to use a method wherein only one of a plurality of heat treatments is carried out by rapid heating using a continuous annealing furnace or transverse flux induction heating, while the other heat treatments are carried out using a batch-type annealing furnace or the like wherein the heating rate is low.

In order to bring the width of grains in a surface layer portion after the final cold rolling to not more than 150 μm, it is still preferred to take into consideration, besides the conditions for heat treatment carried out in the course of cold rolling, the total rolling ratio of cold rolling, carried out up to the heat treatment, for the purpose of reducing a variation from place to place in the amount of deformed zone and shear zone formed by plastic working. It is particularly preferred to take into consideration the total rolling ratio of cold rolling carried out up to the heat treatment by rapid heating. The total rolling ratio of cold rolling before the heat treatment by rapid heating is particularly preferably not less than 50%. The term "total rolling ratio" refers to the total of rolling ratios imparted by a plurality of cold rolling passes or a single cold rolling pass with no heat treatment being incorporated.

In order to bring the ratio of the length of grains in a surface layer portion after the final cold rolling to the width of the grains to not more than 8, it is preferred for the total rolling ratio of cold rolling after the final heat treatment to be not more than 80%. It is a matter of course that, in the design of the step of cold rolling, the rolling ratio of each pass and conditions and timing for heat treatment should be set so that the substrate after the final cold rolling has necessary mechanical strength.

Before heat treatment in the course of cold rolling, deposits such as rolling oil are, if necessary, removed by alkali cleaning or the like.

In the present invention, a strip prepared by continuous casting and rolling is cold-rolled. Therefore, no hot rolling may be carried out prior to cold rolling. Even if hot rolling is carried out, the time necessary for the hot rolling is very short and only about 1/10 of that in the case of the conventional DC process, so that there is no possibility that the strip is exposed to a high temperature for a long period of time. Therefore, little or no elements dissolved to supersaturation in a solid solution form during casting are precipitated in the course of hot rolling, and such elements are for the first time precipitated in the first heat treatment carried out in the course of cold rolling. The precipitation in the course of recrystallization causes many fine precipitated particles to be uniformly dispersed. By virtue of this phenomenon, pits are uniformly formed by electrolytic etching, that is, electrolytic graining can be uniformly carried out.

Thus, the heat treatment in the course of cold rolling primarily contributes to the uniformity of appearance of the grained surface through proper recrystallization and, at the same time, secondarily contributes to the uniformity of electrolytic graining and the uniformity of appearance of the grained surface through the precipitation of elements dissolved to supersaturation in a solid solution form.

The conventional process using DC involves heat treatment of a slab or billet for homogenization, hot rolling, and intermediate annealing in the course of cold rolling. By contrast, in the present invention, a strip prepared by continuous casting and rolling is not hot-rolled, or alternatively even if the strip is hot-rolled, the time necessary for the hot rolling is very short, and the necessary major steps are only cold rolling and heat treatment in the course of the cold rolling. Therefore, the number of necessary steps is much smaller than that of the conventional process. Thus, as compared with the prior art, the present invention is very advantageous in that uniformity of electrolytic graining and uniformity of appearance of the grained surface can be realized by a simple process not requiring much time, at a low cost, and with a high efficiency.

EXAMPLES

Aluminum alloys having compositions specified in Table 1 were continuously cast and rolled, slightly hot-rolled or not hot-rolled, and cold-rolled with heat treatment being incorporated in the course of the cold rolling, thereby preparing cold-rolled sheets of aluminum alloys.

Aluminum alloy A specified in Table 1 was continuously cast and rolled by a hunter continuous cast and rolling machine to prepare a 7 mm-thick strip coil. A cold-rolled sheet having a desired thickness was prepared from the coil by the plate making process specified in Table 2 and then straightened in the rolling direction to prepare an aluminum alloy substrate for a lithographic printing plate.

Aluminum alloy B specified in Table 1 was cast into a 15.8 mm-thick slab by a belt caster type continuous casting and rolling machine. The slab was hot-rolled, and a cold-rolled sheet having a desired thickness was prepared from the hot-rolled sheet by the plate making process specified in Table 2 and then straightened in the rolling direction to prepare an aluminum alloy substrate for a lithographic printing plate.

Conditions for heat treatment in the course of cold rolling were as follows. For heating, the temperature rise rate was 150° C./sec or 10° C./sec for rapid heating and 0.03° C./sec (= 100° C./hr) for slow heating. With respect to holding at a predetermined heat treatment temperature and cooling, when the temperature rise rate was 150° C./sec, as soon as the temperature of the sheet had reached a predetermined value, the sheet was water-cooled at a rate of not less than 500° C./sec; when the temperature rise rate was 10° C./sec, the sheet was held at a predetermined temperature for 1 min and then air-cooled; and when the temperature rise rate was 0.03° C./sec, the sheet was held at a predetermined temperature for 2 hr and then air-cooled.

The heating at a temperature rise rate of 150° C./sec was carried out using a transverse flux induction heater, the heating at a temperature rise rate of 10° C./sec was carried out using an experimental furnace, and the heating at a temperature rise rate of 0.03° C./sec (=100° C./hr) was carried out using a batch-type annealing furnace.

The alloy substrate Nos. 1 to 17 of examples of the present invention and comparative examples prepared by the plate making process specified in Table 2 were subjected to a tensile test to measure mechanical properties, and the uniformity of electrolytic graining and the uniformity of appearance of the grained surface were evaluated as follows.

For the alloy substrates which had been heat-treated in the course of cold rolling according to the present invention, the amounts of major elements dissolved in a solid solution form were Fe≦250 ppm, Si≦150 ppm, and Cu≦120 ppm.

( 1 ) Uniformity of electrolytic graining

The substrates were brush-grained in a pumice stone/water suspension, alkali-etched, and desmut-treated.

Thereafter, electrolytic graining was carried out by electrolytic etching in 1% nitric acid using a power supply providing an electrolytic waveform with alternating polarity at an anodic electricity quantity of 150 Coulomb/dm$^2$.

The treated substrates were cleaned in sulfuric acid, and the surface thereof was observed under a scanning electron microscope (SEM). Further, the surface of the grained substrate was observed by naked eye to evaluate the uniformity of graining. The uniformity was evaluated as "good (○)" when the graining was uniform, "somewhat poor (Δ)" when a few unetched portions were found, and "failed (x)" when many unetched portions were found or graining was nonuniform.

(2) Uniformity of appearance of grained surface

The substrates were brush-grained in a pumice stone/water suspension, alkali-etched, and desmut-treated.

Thereafter, electrolytic graining was carried out by electrolytic etching in 1% nitric acid using a power supply providing an electrolytic waveform with alternating polarity at an anodic electricity quantity of 150 Coulomb/dm$^2$.

The treated substrates were cleaned in sulfuric acid. Then, an anodic oxide film was formed in sulfuric acid, and the surface of the substrates was observed with the naked eye to evaluate the uniformity of appearance. The appearance was evaluated as "good (○)" when the appearance was uniform, "somewhat poor (Δ)" when the appearance was somewhat nonuniform, and "failed (x)" when the appearance was nonuniform or streaks were observed.

The results, together with the final cold rolling ratio, the width of grains in a surface layer portion, and the length of grains in a surface layer portion, are given in Table 3.

As can be seen from Table 3, for the alloy substrates of examples of the present invention (Nos. 2, 3, 4, 5, 8, 10, 12, 14, 15, 16, and 17), the width of grains in the surface layer portion was not more than 150 μm, the ratio of the length to the width (elongation) was not more than 8, and both the uniformity of electrolytic graining and the uniformity of appearance of the electrolytically grained surface were good (○).

By contrast, for the comparative alloy substrates (Nos. 1, 6, 7, 9, 11, and 13), the following defects were found.

For Comparative Example Nos. 1 and 11 wherein the heat treatment in the course of cold rolling specified in the present invention was not carried out, the electrolytic graining was nonuniform, the grains in a surface layer portion had an acicular structure, and the appearance of the grained surface was nonuniform due to significant occurrence of streaks.

For Comparative Example Nos. 6 and 13 wherein the ratio of the length to the width (elongation) with respect to grains in a surface layer portion exceeded 8, i.e., the upper limit specified in the present invention, the appearance of the grained surface was nonuniform due to significant occurrence of streaks, although the uniformity of electrolytic graining was good.

For Comparative Example Nos. 7 and 9 the width of grains in a surface layer portion exceeded 150 μm, i.e., the upper limit specified in the present invention, the appearance of the grained surface somewhat lacked in uniformity.

From the results given in Table 3, it is apparent that in order to improve both the uniformity of electrolytic graining and the uniformity of appearance of the grained surface, it is necessary to satisfy all the requirements specified in the present invention.

As is apparent from the foregoing description, the present invention provides an aluminum alloy substrate for an electrolytically grainable lithographic printing plate by a continuous casting and rolling process, which aluminum alloy substrate can be uniformly grained by electrolysis with uniform appearance of the electrolytically grained surface. Further, the present invention provides a process for producing the aluminum alloy substrate for an electrolytically grainable lithographic printing plate through simple steps not requiring much time at a low cost with a high efficiency.

TABLE 1

| Alloy | Si | Fe | Cu | Ti | Mn | B | Al |
|---|---|---|---|---|---|---|---|
| A | 0.08 | 0.28 | 0.016 | 0.014 | 0.028 | 0.002 | Bal. |
| B | 0.10 | 0.24 | 0.004 | 0.019 | 0.004 | <0.001 | Bal. |

TABLE 2

| No. | Alloy | Cold rolling (mmt) | Heat treatment (temp. rise rate) (temp. × time) | Cold rolling (mmt) | Heat treatment (temp. rise rate) (temp. × time) | Cold rolling (mmt) | |
|---|---|---|---|---|---|---|---|
| 1 | A | — | — | — | — | 0.3 | Comparison |
| 2 | A | — | — | 0.6 | 150° C./sec 460° C.(*) | 0.3 | Invention |
| 3 | A | — | — | 0.6 | 150° C./sec 500° C.(*) | 0.3 | Invention |
| 4 | A | — | — | 0.6 | 150° C./sec 550° C.(*) | 0.3 | Invention |
| 5 | A | — | — | 0.9 | 150° C./sec 460° C.(*) | 0.3 | Invention |
| 6 | A | — | — | 1.5 | 150° C./sec 460° C.(*) | 0.3 | Comparison |
| 7 | A | — | — | 0.6 | 0.03° C./sec 400° C. × 2 hr | 0.3 | Comparison |
| 8 | A | 3.0 | 150° C./sec 460° C.(*) | 0.7 | 0.03° C./sec 400° C. × 2 hr | 0.3 | Invention |
| 9 | A | 3.0 | 0.03° C./sec 400° C. × 2 hr | 0.7 | 0.03° C./sec 400° C. × 2 hr | 0.3 | Comparison |
| 10 | A | 3.0 | 0.03° C./sec 400° C. × 2 hr | 0.7 | 150° C./sec 460° C.(*) | 0.3 | Invention |
| 11 | B | — | — | — | — | 0.3 | Comparison |
| 12 | B | — | — | 0.7 | 150° C./sec 460° C.(*) | 0.3 | Invention |
| 13 | B | — | — | 1.7 | 150° C./sec 460° C.(*) | 0.3 | Comparison |
| 14 | B | 1.7 | 150° C./sec 460° C.(*) | 0.7 | 0.03° C./sec 400° C. × 2 hr | 0.3 | Invention |
| 15 | B | 1.7 | 150° C./sec 460° C.(*) | 0.7 | 150° C./sec 460° C.(*) | 0.3 | Invention |
| 16 | B | 1.7 | 0.03° C./sec 400° C. × 2 hr | 0.7 | 150° C./sec 460° C.(*) | 0.3 | Invention |
| 17 | B | — | — | 0.7 | 10° C./sec 500° C. × 1 min | 0.3 | Invention |

(*)Cooled as soon as the temperature reached the indicated value.

TABLE 3

| No. | Mechanical properties(*) TS | PS | El | Final cold rolling ratio (%) | Grain width (μm) | Length to width ratio of grain | Uniformity of electrolytic graining | Uniformity of appearance of grained surface | |
|---|---|---|---|---|---|---|---|---|---|
| 1 | 211 | 194 | 6.2 | 96 | — | — | x | x | Comparison |
| 2 | 142 | 139 | 2.7 | 50 | 50 | 3 | o | o | Invention |
| 3 | 138 | 135 | 3.4 | 50 | 50 | 3 | o | o | Invention |
| 4 | 138 | 135 | 3.4 | 50 | 50 | 3 | o | o | Invention |
| 5 | 154 | 149 | 3.0 | 67 | 60 | 4 | o | o | Invention |
| 6 | 164 | 161 | 3.5 | 80 | 70 | 8.5 | o | x | Comparison |
| 7 | 138 | 133 | 2.8 | 50 | 160 | 3 | o | Δ | Comparison |
| 8 | 133 | 127 | 3.1 | 50 | 120 | 3 | o | o | Invention |
| 9 | 135 | 129 | 3.1 | 57 | 170 | 3 | o | Δ | Comparison |
| 10 | 142 | 133 | 3.3 | 57 | 70 | 3 | o | o | Invention |
| 11 | 207 | 192 | 5.0 | 82 | — | — | x | x | Comparison |
| 12 | 143 | 136 | 3.1 | 57 | 40 | 3 | o | o | Invention |
| 13 | 166 | 157 | 3.4 | 82 | 70 | 9 | o | x | Comparison |

TABLE 3-continued

| No. | Mechanical properties(*) TS | PS | El | Final cold rolling ratio (%) | Grain width (μm) | Length to width ratio of grain | Uniformity of electrolytic graining | Uniformity of appearance of grained surface | |
|---|---|---|---|---|---|---|---|---|---|
| 14 | 136 | 129 | 3.4 | 57 | 70 | 3 | o | o | Invention |
| 15 | 142 | 137 | 3.2 | 57 | 60 | 3 | o | o | Invention |
| 16 | 142 | 135 | 3.4 | 57 | 60 | 3 | o | o | Invention |
| 17 | 140 | 135 | 3.5 | 57 | 60 | 3 | o | o | Invention |

(*)TS: Tensile strength ($N/mm^2$)
PS: Proof stress ($N/mm^2$)
El : Elongation (%)

We claim:

1. A process for producing an aluminum alloy substrate for an electrolytically grainable lithographic printing plate, said process comprising the steps of:

preparing a melt of an aluminum alloy consisting of 0.20 to 0.80 wt % of Fe with the balance consisting of aluminum, grain refining elements, and unavoidable impurities including 0.3 wt % or less of Si and 0.05 wt % or less of Cu;

continuously casting and rolling said melt to form a strip having a thickness of 20 mm or less;

cold-rolling the strip with a heat treatment in the course of the cold rolling for controlling the dimension and shape of grains in the cold-rolled sheet in its surface layer portion so that the width in a direction parallel to the sheet surface and normal to the direction of cold rolling is not more than 150 μm and the length in a direction parallel to the direction of cold rolling is not more than 8 times said width; and carrying out the heat treatment in the course of said cold rolling in a temperature range of from 440° to 600° C. at least once by a rapid heating sufficient to prevent local grain growth during heating.

2. The process according to claim 1, wherein the total rolling ratio before said rapid heating is not less than 50%.

3. The process according to claim 1, wherein the total rolling ratio after the heat treatment is not more than 80%.

4. The process according to claim 2, wherein the total rolling ratio after the heat treatment is not more than 80%.

* * * * *